US005915938A

United States Patent [19]

Moore

[11] Patent Number: 5,915,938

[45] Date of Patent: Jun. 29, 1999

[54] SAFETY COVER FOR PERCUSSION FIREARMS

[76] Inventor: Michael Alan Moore, 1040 E. Miller St., Griffith, Ind. 46319

[21] Appl. No.: 08/215,467

[22] Filed: Mar. 21, 1994

[51] Int. Cl.[6] ..... F41A 17/00

[52] U.S. Cl. ..... 42/83

[58] Field of Search ..... 42/51, 83

[56] References Cited

U.S. PATENT DOCUMENTS

| | | | |
|---|---|---|---|
| 19,213 | 1/1858 | Smith | 42/83 |
| 35,418 | 5/1862 | Haskins | 42/83 |
| 42,621 | 5/1864 | Lilly | 42/83 |
| 92,398 | 7/1869 | Talbott | 42/83 |
| 96,112 | 10/1869 | Hill et al. | 42/83 |
| 4,485,577 | 12/1984 | Lunders | 42/83 |
| 5,339,553 | 8/1994 | Kearns | 42/83 |

*Primary Examiner*—Charles T. Jordan
*Assistant Examiner*—Theresa M. Wesson
*Attorney, Agent, or Firm*—Ryan M. Fountain

[57] ABSTRACT

A protective cover for firearm percussion caps is provided which is removably mounted to the existing firearm nipple and secured to another portion of the firearm by an elastomeric loop. The cover has a hollow, generally cylindrical configuration formed from resilient and weatherproof material, such as rubber, and can flex off of its longitudinal axis to facilitate installation onto the nipple in close confines. A radially extending handle formed from a more rigid material is mechanically mounted to the cover between two O-rings formed from material more easily bonded to the cover. The interior of the cover is sufficiently resilient and sized so as to sealingly receive most commonly used firearm nipples via an interference fit to prevent moisture penetration to the percussion cap.

8 Claims, 3 Drawing Sheets

SAFETY COVER FOR PERCUSSION FIREARMS

BACKGROUND AND SUMMARY OF THE INVENTION

The present invention relates generally to muzzle loaded firearms, and, more particularly, to safety covers for the percussion caps used to fire such weapons to protect that cap against moisture and inadvertent discharge.

Specifically, the present invention is considered to be an improvement upon the device shown in U. S. Pat. No. 4,485,577, issued to Lunders on Dec. 4, 1984. As discussed in that prior reference, there is a need to protect the percussion caps of muzzle loading firearms from the detrimental effects of moisture and to reduce user injuries from accidental or inadvertent discharges caused by the hammer striking the percussion cap. While in some circumstances the Lunders device can succeed in that regard, it has been found to suffer certain drawbacks.

By way of example, the hammer of a typical old fashioned or replica-type muzzle loader has three positions: down, half-cocked, and full-cocked. In the down position the hammer rests on the nipple or percussion cap mounted on the nipple. Nonetheless, if the hammer is hit or bumped hard enough even in this position, it can set off the percussion cap prematurely. In the half-cocked position the percussion cap is exposed, but the hammer is still considered to be in a "safety" position. The full-cocked position exposes the percussion cap even more and is considered to be the ready to fire position. Hunter safety courses typically teach that the muzzle loader should never be placed in the full cocked position unless the gun is then to be fired at a target.

With the Lunders device, however, it has been found that it is sometimes necessary to put the hammer in the full-cocked position in order to install the cover, since the cover is made of a rigid material, brass. If the recess of the Lunders cover was not drilled deep enough or if the nipple protrudes too far, there is no safety if the hammer is released. Thus, a risk of accidental discharge is created which is greater than if installation could be accomplished in the half-cocked position.

Also, the Lunders device requires the use of a specially formed nipple which must replace the original equipment of the muzzle loader. After repeated use, this special nipple must be replaced by another nipple of that type. Further, the Lunders device is only adapted for use on the old fashioned swing-type or exposed hammer, and not the modern "in-line" style hammers.

Commercial embodiments of the Lunders device have employed an O-rings which is retained by the nipple when the cover is removed for firing. As a result, the O-rings is repeatedly exposed to the intense heat of the nipple, and thereby subject to undesirable degradation, necessitating periodic replacement.

Due to the relative inflexibility of brass, the Lunders device must be placed on and off in the exact same manner. The small projection at the top of the cylinder acts as a handle, but in cold and/or wet weather removal can be difficult. Further, due to the metallic nature of the Lunders device, when serving in its safety capacity, if the hammer strikes the cover, there is a risk that the metal-to-metal contact will damage the hammer.

Finally, Lunders suggests the use of a leather strapping to attach the cover to the trigger guard. It has been found, however, that it is preferable to keep the trigger guard free of all obstructions for improved safety.

Accordingly, it is an object of this invention to provide an improved safety cover for percussion cap-type firearms. Other objects include the provision of a safety cover for percussion caps that:

A. is usable on a wide range of firearms,

B. is readily adaptable to existing firearm nipples,

C. provides a durable and reliable seal against moisture,

D. can be easily installed in the half-cocked hammer position,

E. provides safety against firearm discharge even when not properly installed,

F. is easy to install and remove in adverse weather conditions,

G. is adaptable to attachment to the firearm at a variety of locations, and

H. prevents damage to the firearm hammer in the event of accidental hammer strikes.

These and other objects of the present invention are obtained by the provision of a protective cover for a firearm percussion cap which is removably mounted to the existing nipple and secured to another portion of the firearm via an elastomeric loop. The cover includes a cylindrical portion formed from waterproof resilient material which permits the cylindrical portion to flex off of its longitudinal axis to facilitate installation. A radially extending metal handle is attached intermediate the ends of the cylindrical portion and secures the elastomeric loop to the cover. The handle is mounted between two spaced apart rings formed from material which is readily bonded to the cylindrical portion. Preferably, the handle is coated with a resilient and waterproof material. The interior opening of the cylindrical portion is preferably sized and the material resiliency selected so as to permit a moisture resistant interference seal to be formed with the most commonly used nipple dimensions. In addition, the resiliency and thickness of the material selected for the closed end of the cover is preferably such that the force of a hammer strike is absorbed sufficiently to prevent firing of the percussion cap. Further, the interior of the cover can be sized so as to have clearance between the percussion cap and the closed end of the cover.

Other objects advantages and novel features of the present invention will now become readily apparent to those of skill in the art upon consideration of the following drawings and detailed description.

DESCRIPTION OF PREFERRED EMBODIMENTS

Figure 1:
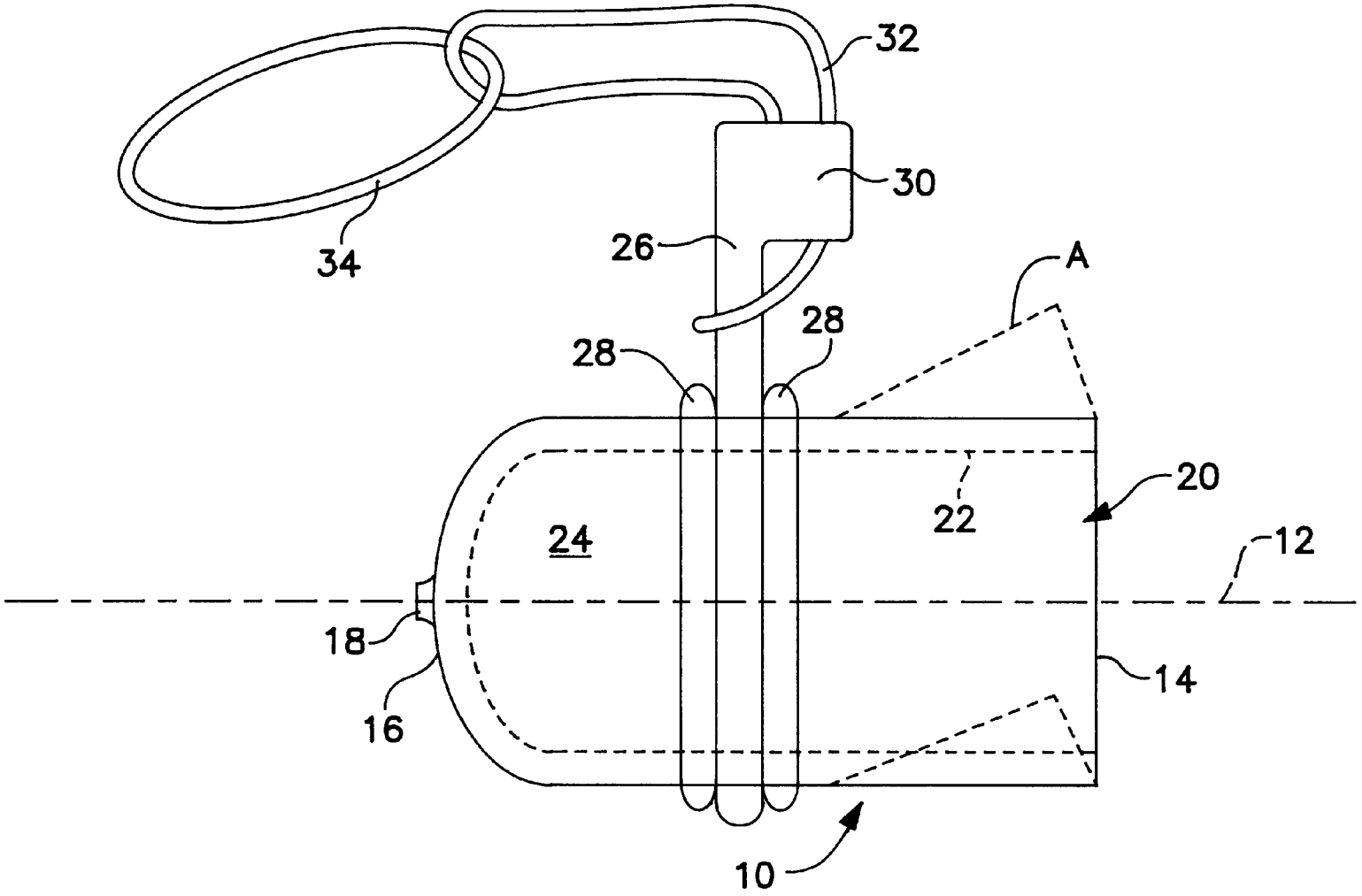
FIG. 1 shows a side view of a safety cover for a percussion firearm according to the teachings of the present invention.

FIG. 1, which illustrates a preferred embodiment of the present invention, shows a protective safety cover 10 formed as a generally cylindrical, hollow element extending along a longitudinal axis 12. This cylindrical cover has an open end 14 and a closed end 16. The closed end may, for example, be formed with a protrusion or dimple 18. Preferably, cover 10 is formed from a weather proof and resilient material, such as a hard rubber. To be weather proof, this material should be generally inmpervious to moisture and remain resilient at the low temperatures in which muzzle loader firearms are commonly used. In being resilient, the material should permit the cover to expand slightly to receive a range of conventional firearm nipples by an interference fit and at the same time permit the cover to bend or flex off of its longitudinal axis, as shown at A, in order to facilitate installation in close confines.

Cover 10 includes an interior cavity 20 for receiving therein the nipple and percussion cap mounted on the nipple. In especially preferred embodiments the cover is molded directly to the desired shape from waterproof rubber materials such that interior cavity 20 has a cylindrical wall 22 of rubber with which to form a seal against moisture penetration between the cover and the nipple. At the same time, the rubber on the cover exterior prevents moisture penetration directly to the percussion cap. In this way, misfires of the percussion cap or primary charge in the gun barrel caused by wetting of the explosive can be avoided. When so molded, dimple 18 can be formed as a molding vent or process remanent.

The diameter of interior cavity 20 is, for example, sized so as to closely fit over most commonly used firearm nipples. At the same time, the length of the interior cavity can allow for spacing 24 between the top of the percussion cap and the interior face of closed end 16. Although the resiliency and elastic nature of the cover tends to absorb the force of a hammer strike toward the percussion cap, this spacing can provide an extra measure of safety against inadvertent discharges.

A handle 26 is provided to facilitate mounting and dismounting of the cover on the firearm nipple and percussion cap. This handle is, for example, mounted on cover 10 between ends 14 and 16 by placement between two spaced apart O-rings 28. These O-rings are preferably formed from material which is readily bonded to or integrally formed with the material of cover 10. In the present example, this material would also be a hard rubber and the bonding can be achieved by a rubber cement. On the other hand, handle 26 is preferably formed from a more rigid material, such as metal so that it can be more firmly manipulated. By clamping handle 26 between O-rings 28, a secure mechanical connection is made with cover 10 despite the diverse materials used.

Handle 26 is preferably formed to extend radially away from cover 10 and have a length sufficient to permit easy gripping by the user. In this way, handle 26 can provide mechanical leverage in manipulation of cover 10. At the same time, it has been found to be advantageous to coat or paint handle 26 with a material which is also waterproof and somewhat resilient. One end 30 of the handle can be bent or formed so as to receive and retain an elastic loop or enlarged O-rings 32. This loop is dimensioned so as to loosely fit over a nearby portion of the firearm, such as to the hammer in FIG. 2, in order to retain the cover in a convenient location when it is removed from the nipple. Where desired, additional loops 34 can be employed to secure the cover to a more distant location, as shown in FIG. 3. Additional loops 34 can, for example, be formed similarly to a rubber band.

Figure 2A:
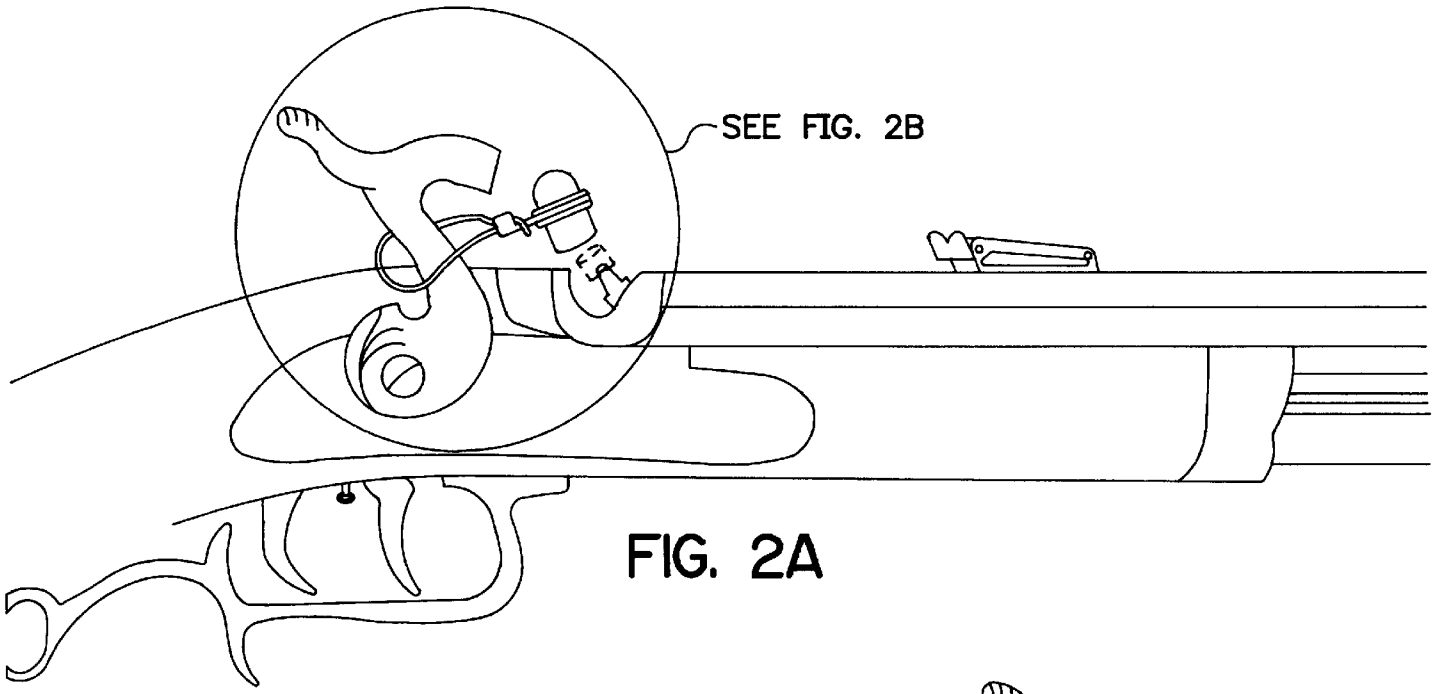
FIG. 2 shows a side view of an application of the safety cover of FIG. 1 on an old fashion style side hammer muzzle loader.
Figure 2B:
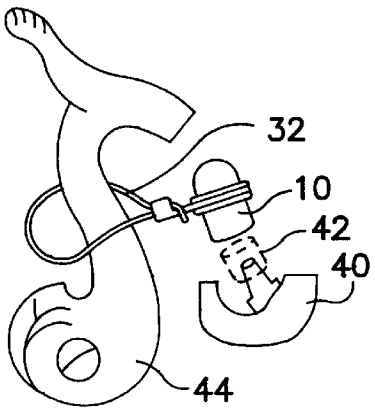
Figures 3A, 3B:
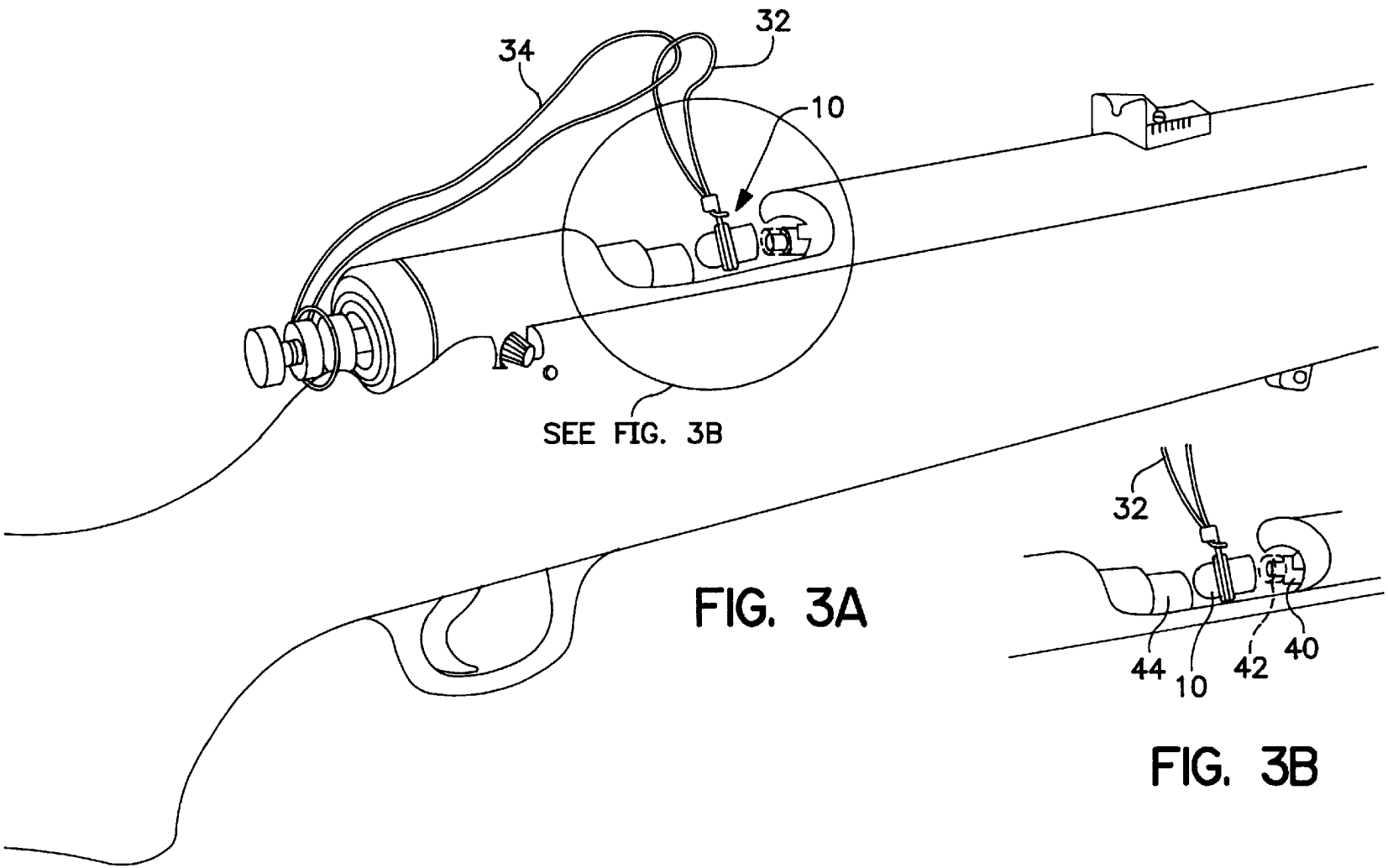
FIG. 3 shows a side view of another application of the safety cover of FIG. 1 on a modern "in-line" style muzzle loader.

In use, cover 10 can be installed on either an old fashioned style side hammer muzzle loader or a modem "in line" style muzzle loader, as shown in FIGS. 2 and 3, by moving the hammer to the half-cocked position. After installation it is often preferable to release the hammer onto the cover. By way of reference, in FIGS. 2 and 3 the nipple is denoted as element 40, the percussion cap as element 42, and the hammer as element 44. To install or mount cover 10 it is not necessary to move the hammer to the full-cocked position since even in close confines cover 10 will flex to fit over the nipple. The offset or side mounted position of handle 26 provides leverage to facilitate that flexing where needed and, in addition, permits a shorter longitudinal length of cover 10 which facilitates installation on "in-line" style muzzle loaders. Since interior cavity is sized and sufficiently resilient to receive nipples of various common sizes, no special nipple needs to be installed in the firearm Further, since the entire interior wall 22 is, for example, formed of rubber and can serve to seal against moisture and the cover is completely removed from the percussion cap before firing, a more long lasting and reliable seal is available with the present invention. Being made of resilient material, particularly at closed end 16 which would receive a hammer strike, cover 10 presents no risk of damage to the cast metal of the hammer and can prevent firearm discharge, even if not properly or completely installed since the force of the hammer strike is absorbed by the rubber, rather than resisted (as by impact on a metal cover). Also, use of elastic loops to attach the cover to the firearm when the cover is removed form the nipple permits greater flexibility and ease in the location of that being attachment. Instead of attachment to the hammer as shown, the present invention can be attached to the stock or scope of the firearm or any other location convenient to use and not obstructing the firearm operation.

Although preferred embodiments of the present invention have been described above in detail, the same is by way of illustration and example only, and not as a limitation. Accordingly, the spirit and scope of the present invention are limited only by the terms of the claims below.

What is claimed is:

1. A protective cover for a firearm having a percussion cap mounted to a nipple thereon and a hammer for striking said percussion cap, said cover being removably mounted over said percussion cap and between said hammer and said cap, said cover comprising:

a cover extending along a longitudinal axis and being formed from a waterproof material which is sufficiently resilient so as to permit said cover to be bendable off of that longitudinal axis, said cover being closed at one end thereof and open at another end with an interior cavity being defined therebetween, said interior cavity being sized so as to fit closely over said nipple, a handle joined to said cover by a cantilevered connection at a point between the ends of said cover and extending substantially perpendicular to said longitudinal axis for a given length toward a free end, said cantilevered connection extending for a relatively short length along said longitudinal axis and said given length being sufficiently long that application of force to the free end of said handle will permit said handle to move at least a portion of said cover out of alignment with said longitudinal axis, and a loop member connected to said handle and formed from elastomeric material, said loop being dimensioned so as to be attachable to a portion of said firearm.

2. The protective cover according to claim 1 wherein said interior cavity includes at least a cylindrical wall formed from resilient material and dimensioned so as to receive said nipple via an interference fit which seals against moisture penetration to said percussion cap.

3. The protective cover according to claim 2 wherein said cover includes at least two closely spaced rings on its exterior surface which are formed from materials which are readily bonded to said cover, and wherein said handle is formed from a more rigid material than the material of said cover and is retained to said cover by mounting between said rings.

4. The protective cover according to claim 3 wherein said handle has an exterior surface coating which is resilient and waterproof.

5. The protective cover according to claim 4 wherein said interior cavity is sized so as to receive said percussion cap with clearance between said percussion cap and said closed end of said cover.

6. A protective cover for a firearm having a percussion cap mounted to a nipple thereon and a hammer for striking said percussion cap, said cover being removably mounted over said percussion cap and between said hammer and said cap, said cover comprising:

a cylindrical cover extending along a longitudinal axis and being formed from a waterproof material which is sufficiently resilient so as to permit said cover to be bendable off of that longitudinal axis, said cover being closed at one end thereof and open at another end with an interior cavity being defined therebetween, said interior cavity being sized so as to fit closely over said nipple and including at least a cylindrical wall formed from resilient material and dimensioned so as to receive said nipple via an interference fit which seals against moisture penetration to said percussion cap, a handle connected to said cover at a point between the ends thereof and extending substantially perpendicular to said longitudinal axis, said cover including at least two closely spaced rings on its exterior surface which are formed from materials which are readily bonded to said cover, said handle is formed from a more rigid material than the material of said cover and is retained to said cover by mounting between said rings, and a loop member connected to said handle and formed from elastomeric material, said loop being dimensioned so as to be attachable to a portion of said firearm.

7. The protective cover according to claim 6 wherein said handle has an exterior surface coating which is resilient and waterproof.

8. The protective cover according to claim 6 wherein said interior cavity is sized so as to receive said percussion cap with clearance between said percussion cap and said closed end of said cover.

* * * * *